United States Patent [19]

Heskel

[11] Patent Number: 4,780,578

[45] Date of Patent: Oct. 25, 1988

[54] ANEROBIC SEALED ROTARY SWITCH

[75] Inventor: Isaac H. Heskel, Highland Pk., Ill.

[73] Assignee: Oak Industries, Inc., Rancho Bernardo, Calif.

[21] Appl. No.: 131,940

[22] Filed: Dec. 11, 1987

[51] Int. Cl.[4] ..... H01H 19/08; H01H 21/12

[52] U.S. Cl. ..... 200/11 R; 174/525; 200/302.1

[58] Field of Search ..... 29/592 R, 883, 885; 174/52 R, 52 S, 52 PE, 84 R, 93, 152 R, 153 R; 200/2, 11 R, 11 A, 11 D, 11 DA, 11 G, 11 J, 11 K, 11 TW, 155 R, 237, 284, 302.1; 264/262, 265, 271.1; 338/275; 361/433 H, 433 T; 427/116, 118; 439/709, 733, 736

[56] References Cited

U.S. PATENT DOCUMENTS

| | | | |
|---|---|---|---|
| 2,658,130 | 11/1953 | Bondurant | 200/302.1 |
| 3,043,922 | 7/1962 | Laviana et al. | 200/11 J X |
| 3,172,974 | 3/1965 | Perrino | 200/82 D |
| 3,226,498 | 12/1965 | Carpenter | 200/24 |
| 3,227,822 | 1/1966 | Corey | 200/11 H |
| 3,255,319 | 6/1966 | Paine | 200/302.1 X |
| 3,388,212 | 6/1968 | Nichols et al. | 264/262 X |
| 3,398,332 | 8/1968 | Logan | 361/433 H |
| 3,504,106 | 3/1970 | Keto | 174/152 R |
| 3,522,575 | 8/1970 | Watson et al. | 174/153 R |
| 3,889,047 | 6/1975 | Carver | 174/84 R |
| 4,107,451 | 8/1978 | Smith, Jr. et al. | 174/93 |
| 4,144,418 | 3/1979 | Girard et al. | 200/2 X |
| 4,145,588 | 3/1979 | Orcutt | 200/83 P |
| 4,442,138 | 4/1984 | Bich et al. | 427/116 |
| 4,527,023 | 7/1985 | Ohashi et al. | 200/11 K X |

*Primary Examiner*—J. R. Scott

*Attorney, Agent, or Firm*—Kinzer, Plyer, Dorn, McEachran & Jambor

[57] ABSTRACT

A rotary switch includes an open ended housing and a stator closing the open end of the housing. There is a seal member positioned between the stator and housing. The stator is formed of plastic and has a plurality of metallic terminals extending outwardly therefrom. There is an anerobic seal filling gaps between the stator and terminals caused by material shrinkage during setting of the plastic stator.

3 Claims, 1 Drawing Sheet

ANEROBIC SEALED ROTARY SWITCH

SUMMARY OF THE INVENTION

The present invention relates to switches, and particularly a rotary switch having an airtight anerobic seal for the switch terminals.

A primary purpose is a rotary switch having a plastic stator molded about metal terminals and an anerobic seal filling any gaps between the plastic and terminals caused by material shrinkage during setting of the plastic.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
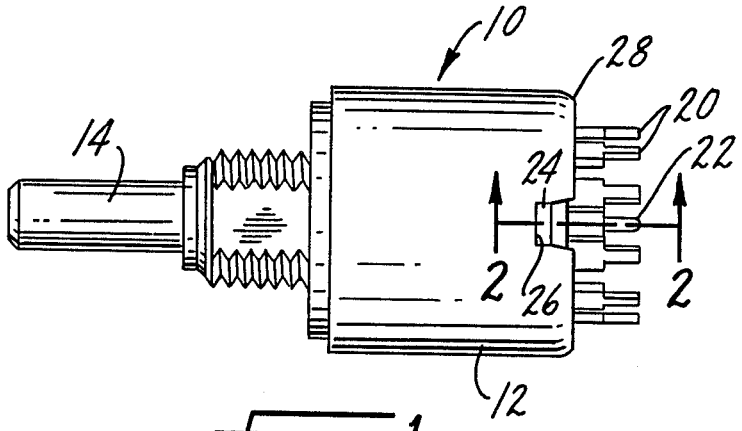
FIG. 1 is a side view of a rotary switch.

There are many switch applications which require that the switch housing have an airtight seal, primarily to prevent contamination and subsequent corrosion of the interior contacts. A common path for air to reach the interior of the switch is the gaps created between the molded plastic stator and the metal switch terminals due to material shrinkage during setting of the plastic stator. In the past, these gaps were sealed by coating the stator exterior with an epoxy. The present invention provides an airtight seal by applying an anerobic seal in the form of a wet vacuum applied resin using a process developed by Loctite Corporation of Newington, Ct.

In the drawings, a rotary switch 10 has a housing 12 and a rotor shaft assembly 14. The rotor details, which may be conventional, have been omitted for clarity.

Figure 2:
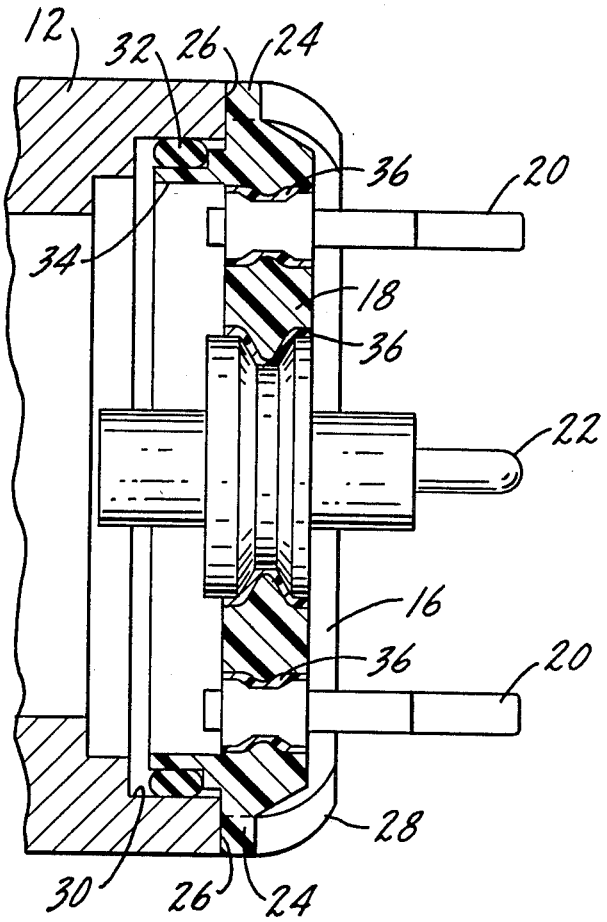
FIG. 2 is an enlarged section along plane 2—2 of FIG. 1, with portions of the rotary switch removed for clarity.

As shown particularly in FIG. 2, housing 12 has an open end 16 which is closed by a stator 18. The stator is plastic and is molded about a circular array of blade terminals 20 and a centrally positioned common terminal 22. Stator 18 has diammetrically oppositely positioned projections 24 which fit within slots 26 in the housing open end. The stator is held in position on the housing by crimping the outer peripheral edges over the stator outside of projections 24, as indicated at 28.

The housing has an annular recess 30 adjacent its open end 16 and an annular seal ring 32 is positioned within the recess. Stator 18 has an inwardly extending annular projection 34 which confines the seal ring within recess 30.

The gaps between terminals 20 and 22 and the plastic stator are filled with a resin, indicated at 36, the gaps being shown out of proportion to their actual size for purposes of explanation. The stator is formed by positioning the terminals in a mold prior to introducing a thermosetting plastic which forms the stator. The gaps 36 are formed because of shrinkage of the plastic as it sets. In practice, although the gaps may be minute, if unsealed they will provide multiple paths for air to reach the housing interior. It is important that these gaps be sealed.

In the present invention an anerobic sealing resin is applied to the molded stator by vacuum impregnation in one of the processes currently marketed by Loctite Corporation. The resin fills the gaps and completely seals the stator. Since seal ring 32 forms a seal between the housing and stator, the interior of the housing has an airtight seal.

Whereas the preferred form of the invention has been shown and described herein, it should be realized that there may be many modifications, substitutions and alterations thereto.

The embodiments of the invention in which an exclusive property or privilege is claimed are defined as follows:

1. A rotary switch including a housing having an open end, a stator closing said housing open end, a seal member between said stator and housing, said stator having a plurality of terminals extending outwardly therefrom, said stator being formed of a plastic material and said terminals being metallic, said plastic stator being molded about said metallic terminals, and an anerobic seal filling gaps between said stator and terminals caused by material shrinkage during setting of the plastic.

2. The rotary switch of claim 1 further characterized in that the open end of said housing has an annular recess, said stator having an annular projection adjacent said recess, said seal member being positioned in said recess and confined by said projection.

3. The rotary switch of claim 1 further characterized in that said anerobic seal is a resin applied to said stator by vacuum impregnation.

* * * * *